US009719297B1

(12) United States Patent
Chen

(10) Patent No.: US 9,719,297 B1
(45) Date of Patent: Aug. 1, 2017

(54) ROLLER SHADE WITH A LIGHT REGULATING FUNCTION

(71) Applicant: Calendar Enterprises Co., Ltd., Chang-Hwa Hsien (TW)

(72) Inventor: Ju-Huai Chen, Chang-Hwa Hsien (TW)

(73) Assignee: Calendar Enterprise Co., Ltd., Chang-Hwa Hsien (TW)

( * ) Notice: Subject to any disclaimer, the term of this patent is extended or adjusted under 35 U.S.C. 154(b) by 0 days.

(21) Appl. No.: 15/008,307

(22) Filed: Jan. 27, 2016

(51) Int. Cl.

| | |
|---|---|
| ***E06B 9/08*** | (2006.01) |
| ***E06B 9/34*** | (2006.01) |
| ***E06B 9/264*** | (2006.01) |
| ***E06B 9/322*** | (2006.01) |
| ***E06B 9/58*** | (2006.01) |
| *E06B 9/24* | (2006.01) |

(52) U.S. Cl.
CPC ..... *E06B 9/34* (2013.01); *E06B 9/264* (2013.01); *E06B 9/322* (2013.01); *E06B 9/581* (2013.01); *E06B 2009/2405* (2013.01)

(58) Field of Classification Search
CPC .... E06B 9/34; E06B 2009/2435; E06B 9/264; E06B 9/322; E06B 2009/2405
USPC ..... 160/133
See application file for complete search history.

(56) References Cited

U.S. PATENT DOCUMENTS 6,116,325 A * 9/2000 Colson ..... E06B 9/32 160/321
6,196,508 B1 * 3/2001 Nijs ..... A47H 1/13 248/267
6,782,938 B2 * 8/2004 Colson ..... E06B 9/32 160/121.1
7,311,131 B2 * 12/2007 Nien ..... E06B 9/34 160/121.1
7,380,582 B1 * 6/2008 Anderson ..... E06B 9/34 160/323.1
7,549,455 B2 * 6/2009 Harper ..... E06B 9/264 160/121.1
7,836,937 B2 * 11/2010 Anderson ..... E06B 9/34 160/170
(Continued)

FOREIGN PATENT DOCUMENTS

CA 2475716 A1 * 9/2005 ..... E06B 9/262
TW DE 202016100428 U1 * 2/2016 ..... E06B 9/42
(Continued)

*Primary Examiner* — Katherine Mitchell
*Assistant Examiner* — Johnnie A Shablack
(74) *Attorney, Agent, or Firm* — Alan D. Kamrath; Kamrath IP Lawfirm, P.A.

(57) ABSTRACT

A roller shade includes a frame unit (1), a micro-adjustment device (2) connected with the frame unit, and a shading unit (3) connected with the micro-adjustment device. The micro-adjustment device includes a drive shaft (21) mounted on the frame unit. The shading unit includes a first shade cloth (31) secured to a rear portion the drive shaft, a second shade cloth (32) secured to a front portion of the drive shaft, and a plurality of separation slats (33) mounted between the first shade cloth and the second shade cloth. When the shading unit is fully expanded, the inclined angle of each of the separation slats is adjusted by operation of the micro-adjustment device so as to regulate the lightness of the sunshine entering the house and to adjust the shading effect of the shading unit.

5 Claims, 9 Drawing Sheets

(56) References Cited

U.S. PATENT DOCUMENTS 8,186,413 B2 * 5/2012 Fujita ..... E06B 9/32 160/121.1
8,251,120 B2 * 8/2012 Chen ..... E06B 9/42 160/314
8,418,742 B2 * 4/2013 Anderson ..... E06B 9/34 160/308
8,672,115 B1 * 3/2014 Jennings ..... E06B 9/56 160/298
9,260,914 B2 * 2/2016 Certain ..... E06B 9/26
9,328,555 B2 * 5/2016 Faller ..... E06B 9/26
9,347,261 B2 * 5/2016 Blair ..... E06B 9/42
9,353,570 B2 * 5/2016 Smith ..... E06B 9/38
9,410,366 B2 * 8/2016 Kwak ..... E06B 9/262
2005/0183835 A1 * 8/2005 Nien ..... E06B 9/50 160/321
2007/0175596 A1 * 8/2007 Chien ..... E06B 9/34 160/121.1
2008/0121353 A1 * 5/2008 Detmer ..... E06B 9/72 160/266
2010/0006238 A1 * 1/2010 Cheng ..... A47H 23/06 160/237
2011/0031343 A1 * 2/2011 Anderson ..... E06B 9/34 242/396.4
2013/0068904 A1 * 3/2013 Wills ..... E06B 9/50 248/207
2014/0262066 A1 * 9/2014 Certain ..... E06B 9/26 160/84.02
2014/0262068 A1 * 9/2014 Buccola, Jr. ..... E06B 9/322 160/120
2014/0262069 A1 * 9/2014 Drew ..... E06B 9/44 160/120
2015/0368968 A1 * 12/2015 Smith ..... E06B 9/50 160/311
2016/0010390 A1 * 1/2016 Smith ..... E06B 9/60 160/302
2016/0130863 A1 * 5/2016 Cheng ..... E06B 9/40 160/179
2016/0130870 A1 * 5/2016 Cheng ..... E06B 9/40 160/309
2016/0258211 A1 * 9/2016 Smith ..... E06B 9/38

FOREIGN PATENT DOCUMENTS

TW DE 202016100332 U1 * 3/2016 ..... E06B 9/34
TW GB 2534008 A * 7/2016 ..... E06B 9/40

* cited by examiner

ROLLER SHADE WITH A LIGHT REGULATING FUNCTION

BACKGROUND OF THE INVENTION

1. Field of the Invention

The present invention relates to a window accessory and, more particularly, to a roller shade.

2. Description of the Related Art

A conventional suspension shade comprises a shading cloth having an upper end, a lower end and a cloth face, at least one magnetic unit mounted on a determined portion of the cloth face of the shading cloth, and at least one metallic unit mounted on the cloth face of the shading cloth with a determined distance being defined between the metallic unit and the magnetic unit. When in use, the metallic unit is attracted by and attached to the magnetic unit to fold the shading cloth so as to adjust the shading effect of the shading cloth.

BRIEF SUMMARY OF THE INVENTION

The primary objective of the present invention is to provide a roller shade with a light regulating function.

In accordance with the present invention, there is provided a roller shade comprising a frame unit, a micro-adjustment device connected with the frame unit, and a shading unit connected with the micro-adjustment device. The frame unit includes a fixed track, a first side bracket mounted on a first end of the fixed track, a second side bracket mounted on a second end of the fixed track, and a rotary wheel module mounted in the second side bracket. The first side bracket has a face provided with a shaft hole and a guide rail located above the shaft hole. The guide rail is provided with a guide slot. The second side bracket has a face provided with a shaft hole. The micro-adjustment device includes a drive shaft mounted on the frame unit, an adjusting shaft provided on a first end of the drive shaft and pivotally mounted in the shaft hole of the first side bracket, a pivot shaft provided on a second end of the drive shaft and pivotally mounted in the shaft hole of the second side bracket, and a slide slidably mounted on the guide rail and co-operating with the adjusting shaft. The adjusting shaft has a periphery provided with an adjusting portion located at the first side bracket. The pivot shaft is connected with the rotary wheel module. The shading unit includes a first shade cloth having an upper end secured to a rear portion of a top of the drive shaft, a weight bar mounted on a lower end of the first shade cloth, a second shade cloth having an upper end secured to a front portion of a top of the drive shaft, and a plurality of separation slats mounted between the first shade cloth and the second shade cloth. When the shading unit is pulled down and expanded fully, the adjusting portion of the adjusting shaft and the slide are disposed at a positioned state, the first shade cloth and the second shade cloth correspond to each other, and the separation slats are arranged transversely and are parallel with each other. When the shading unit is folded upward, the drive shaft is rotated, so that the slide is detached from the adjusting portion of the adjusting shaft, and the separation slats are arranged in an upright manner, and are distributed fully between the first shade cloth and the second shade cloth.

According to the primary advantage of the present invention, when the shading unit is fully expanded, the inclined angle of each of the separation slats is adjusted by operation of the micro-adjustment device so as to regulate the lightness of the sunshine entering the house and to adjust the shading effect of the shading unit.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
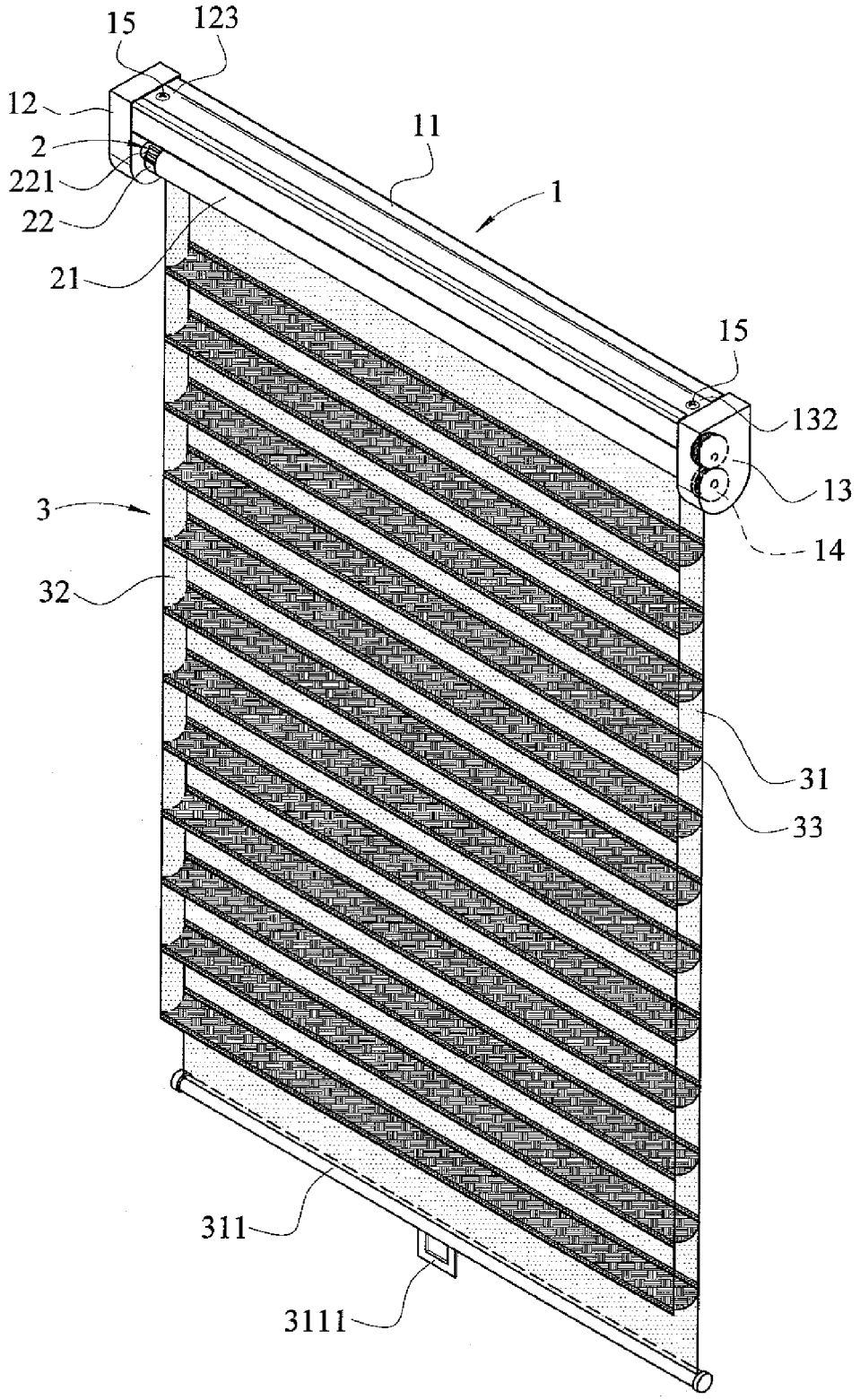
FIG. 1 is a perspective view of a roller shade in accordance with the preferred embodiment of the present invention.

Referring to the drawings and initially to FIGS. 1-4, a roller shade in accordance with the preferred embodiment of the present invention comprises a frame unit 1, a micro-adjustment device 2 connected with the frame unit 1, and a shading unit 3 connected with the micro-adjustment device 2.

The frame unit 1 includes a fixed track 11, a first side bracket 12 mounted on a first end of the fixed track 11, a second side bracket 13 mounted on a second end of the fixed track 11, and a rotary wheel module 14 mounted in the second side bracket 13. The first side bracket 12 has a face provided with a shaft hole 121 and a guide rail 122 located above the shaft hole 121. The guide rail 122 is provided with a guide slot 1221. The second side bracket 13 has a face provided with a shaft hole 131. The rotary wheel module 14 is used to drive the micro-adjustment device 2 and the shading unit 3 so that the shading unit 3 is pulled downward and hangs down or folded upward. The first side bracket 12 has a top provided with a first locking plate 123 extending outward. The second side bracket 13 has a top provided with a second locking plate 132 extending outward. The first locking plate 123 of the first side bracket 12 and the second locking plate 132 of the second side bracket 13 are locked onto the fixed track 11 by two fastener members 15.

The micro-adjustment device 2 includes a drive shaft 21 mounted on the frame unit 1, an adjusting shaft 22 provided on a first end of the drive shaft 21 and pivotally mounted in the shaft hole 121 of the first side bracket 12, a pivot shaft 23 provided on a second end of the drive shaft 21 and pivotally mounted in the shaft hole 131 of the second side bracket 13, and a slide 24 slidably mounted on the guide rail 122 and co-operating with the adjusting shaft 22. The adjusting shaft 22 has a periphery provided with an adjusting portion 221 located at the first side bracket 12. The pivot shaft 23 is connected with the rotary wheel module 14.

The shading unit 3 includes a first shade cloth. 31 having an upper end secured to a rear portion of a top of the drive shaft 21, a weight bar 311 mounted on a lower end of the first shade cloth 31, a second shade cloth 32 having an upper end secured to a front portion of a top of the drive shaft 21, and a plurality of separation slats 33 mounted between the first shade cloth 31 and the second shade cloth 32. The first shade cloth 31 hangs down and is made of light permeable material. The second shade cloth 32 hangs down and is made of light permeable material. Each of the separation slats 33 is made of light impermeable material. The weight bar 311 is provided with a drive portion 3111. Preferably, both of the first shade cloth 31 and the second shade cloth 32 are made of yarn.

Figure 8:
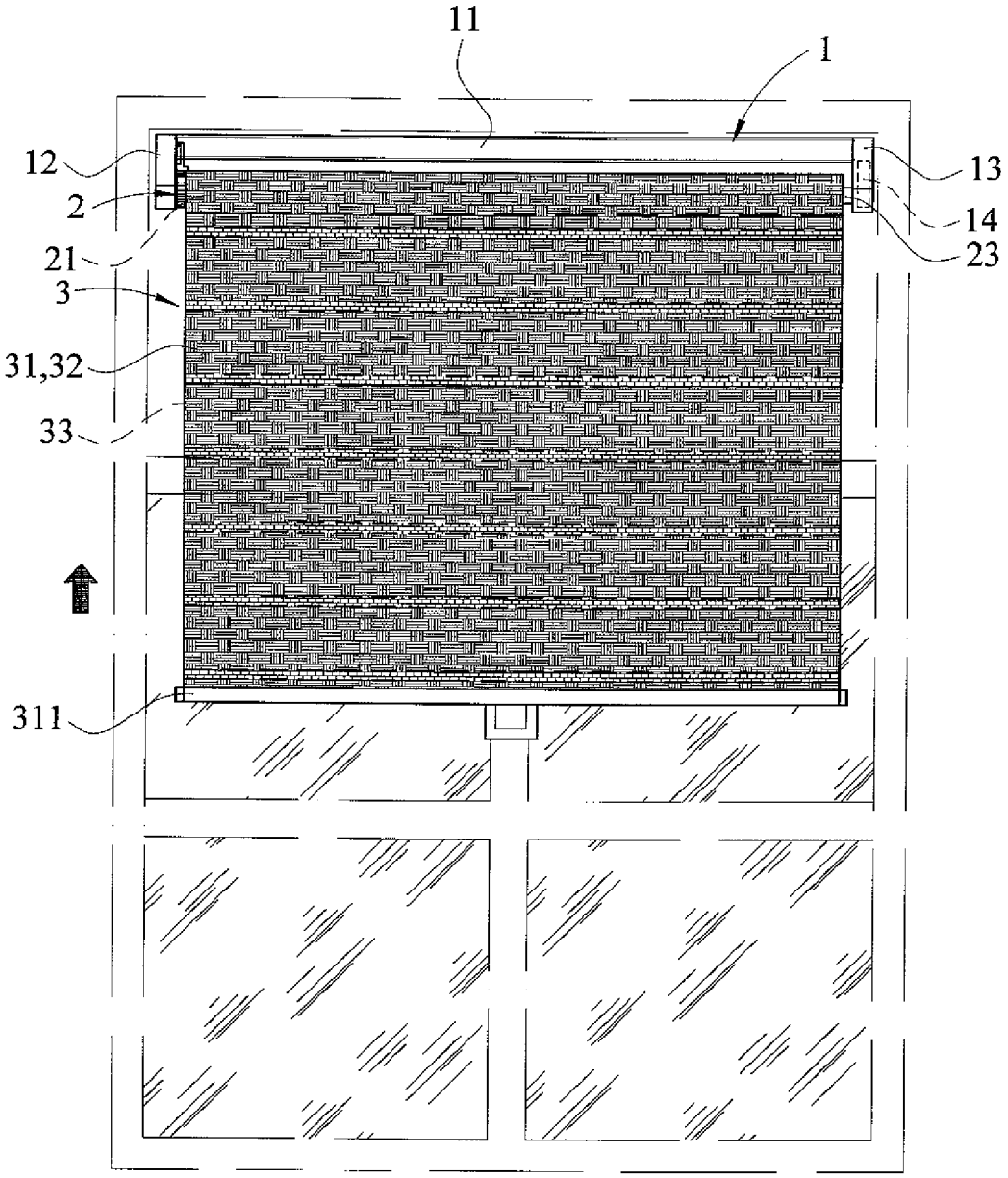
FIG. 8 is a schematic operational view showing folding of the shading unit of the roller shade as shown in FIG. 1.

In practice, when the shading unit 3 is pulled down and expanded fully, the adjusting portion 221 of the adjusting shaft 22 and the slide 24 are disposed at a positioned state. At this time, the first shade cloth 31 and the second shade cloth 32 correspond to each other, and the separation slats 33 are arranged transversely and are parallel with each other as shown in FIG. 1, so that light of an ambient environment passes through the first shade cloth 31, the separation slats 33 and the second shade cloth 32 into an interior of a house. On the contrary, when the shading unit 3 is folded upward, the drive shaft 21 is rotated, so that the slide 24 is detached from the adjusting portion 221 of the adjusting shaft 22. At this time, the separation slats 33 are arranged in an upright manner, and are juxtaposed to each other and distributed fully between the first shade cloth 31 and the second shade cloth 32 as shown in FIG. 8.

In the preferred embodiment of the present invention, the adjusting portion 221 of the adjusting shaft 22 includes a plurality of ribs 2211 arranged on the periphery of the adjusting shaft 22, and a plurality of grooves 2212 defined between the ribs 2211. The ribs 2211 are arranged in an annular manner and are equally distant from each other. Preferably, the ribs 2211 and the grooves 2212 of the adjusting portion 221 have an area of about one quarter to one half (¼-½) of that of the periphery of the adjusting shaft 22.

The slide 24 has a first side provided with a block 241 and a second side provided with an abutting portion 2413. The block 241 has a face provided with a slideway 2411 mounted on the guide rail 122 and has a side provided with a pin hole 2412 connected to the slideway 2411, and a limit pin 25 extends through the pin hole 2412 of the block 241 and the guide slot 1221 of the guide rail 122 so that the slide 24 is mounted on the guide rail 122. The abutting portion 2413 extends from the block 241. The block 241 has a bottom provided with two positioning ribs 242 engaging the grooves 2212 of the adjusting portion 221. Preferably, the guide slot 1221 of the guide rail 122 has an elongate shape, and the limit pin 25 is movable in the guide slot 1221 of the guide rail 122, so that the slide 24 is slidable on the guide rail 122. Preferably, a distance between the two positioning ribs 242 is equal to that between the grooves 2212 of the adjusting portion 221.

Figure 2:
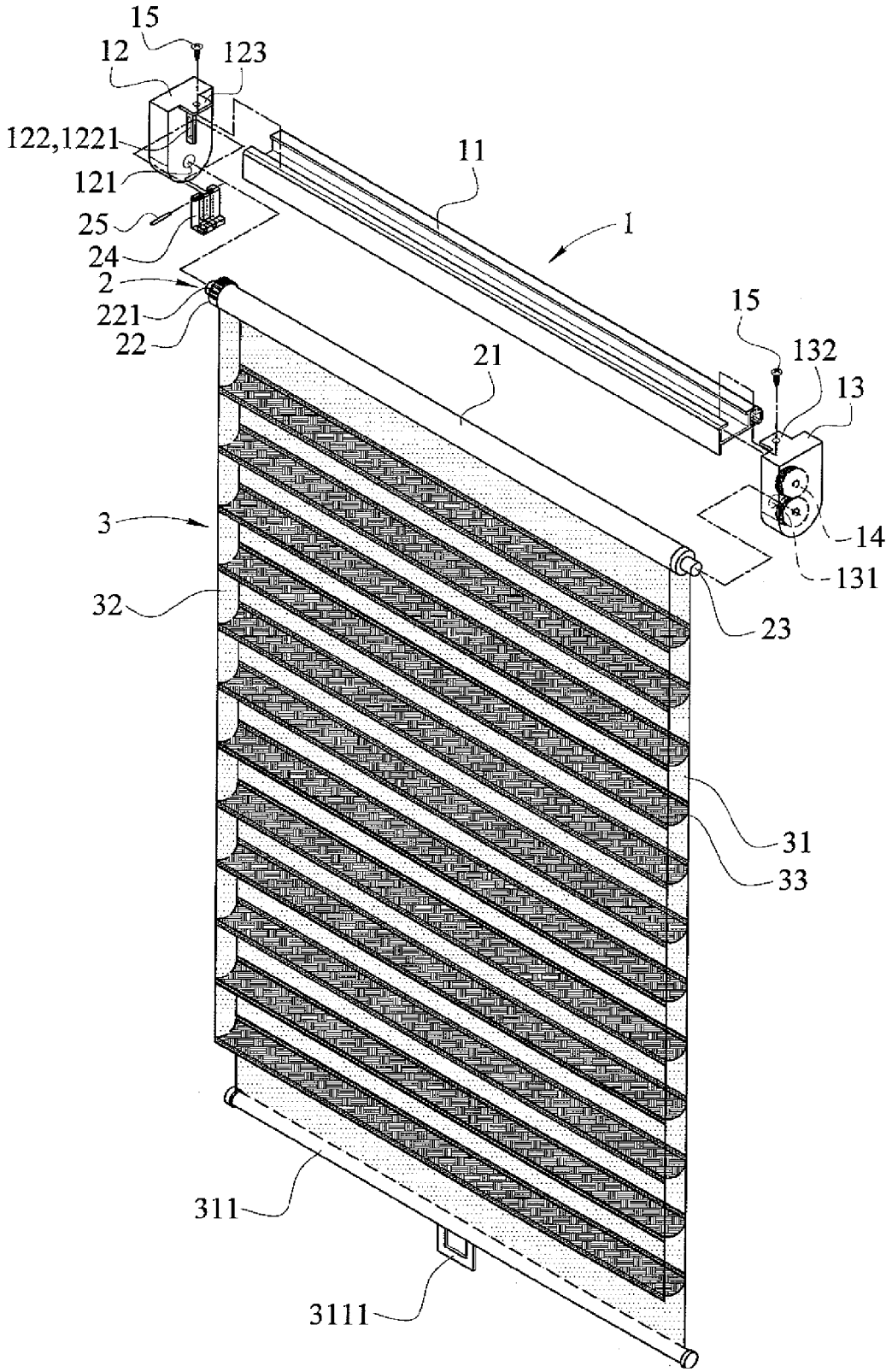
FIG. 2 is an exploded perspective view of the roller shade as shown in FIG. 1.
Figure 3:
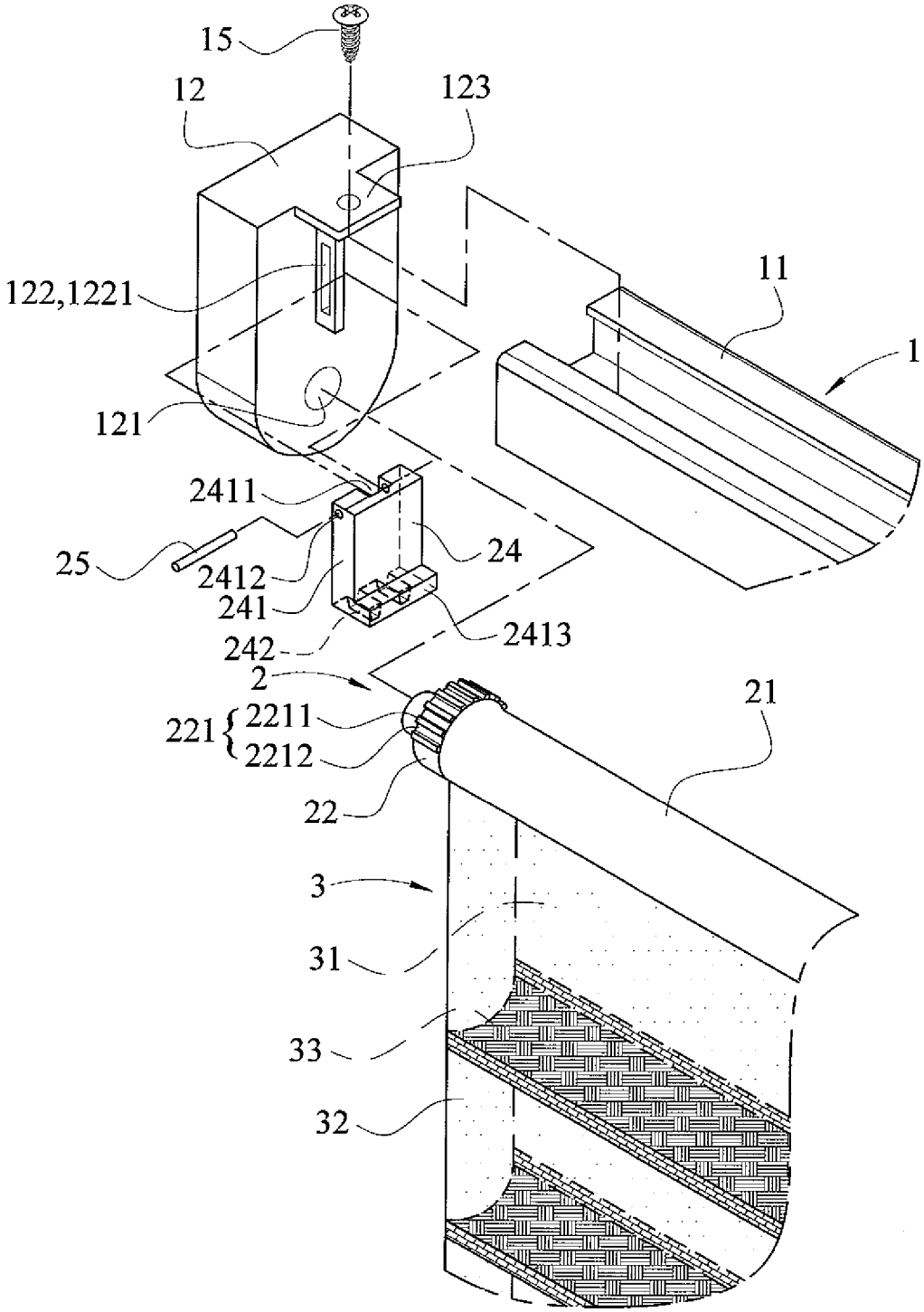
FIG. 3 is a locally enlarged view of the roller shade as shown in FIG. 2.
Figure 4:
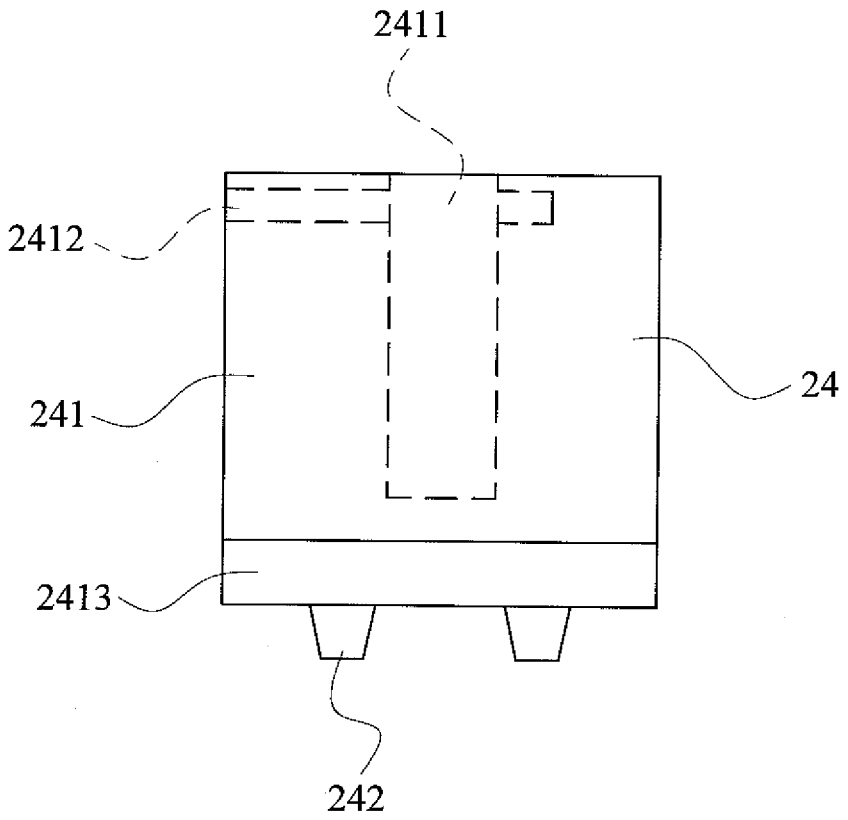
FIG. 4 is a front view of a slide of the roller shade as shown in FIG. 3.
Figure 5:
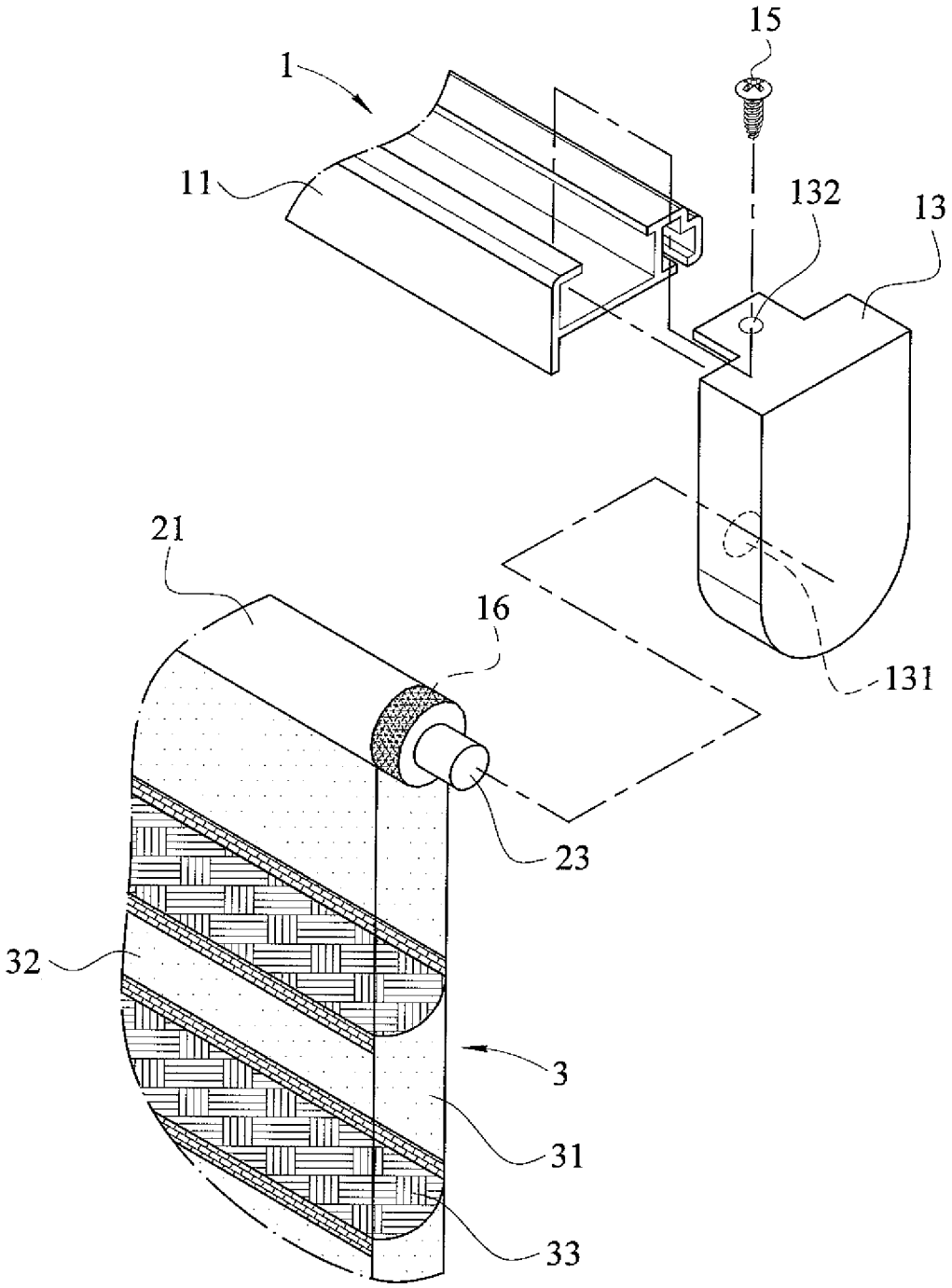
FIG. 5 is a partially exploded perspective view of a roller shade in accordance with another preferred embodiment of the present invention, wherein the rotary wheel module is replaced by an elastic shaft module.

Referring to FIG. 5 with reference to FIG. 2, the rotary wheel module 14 is replaced by an elastic shaft module 16. The elastic shaft module 16 is mounted in an interior of the drive shaft 21 and connected with the pivot shaft 23. The elastic shaft module 16 is used to drive the micro-adjustment device 2 and the shading unit 3 so that the shading unit 3 is pulled downward and hangs down or folded upward.

Figure 9:
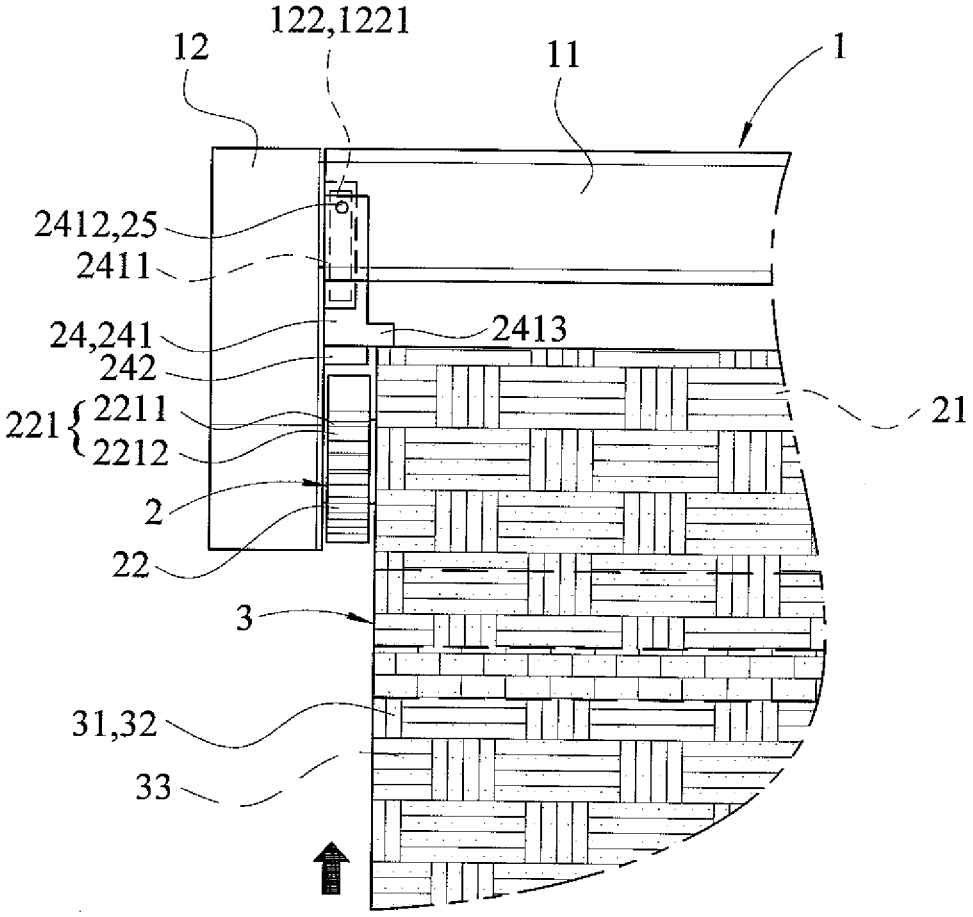
FIG. 9 is a locally enlarged view of the roller shade as shown in FIG. 8.

In operation, referring to FIGS. 6-9 with reference to FIGS. 1-5, the abutting portion 2413 of the slide 24 is located above the drive shaft 21, so that when the shading unit 3 is folded upward, the first shade cloth 31 and the second shade cloth 32 are wound around the drive shaft 21 to push the abutting portion 2413 of the slide 24 upward, such that the positioning ribs 242 are detached from the grooves 2212 of the adjusting portion 221 as shown in FIG. 9.

Figure 6:
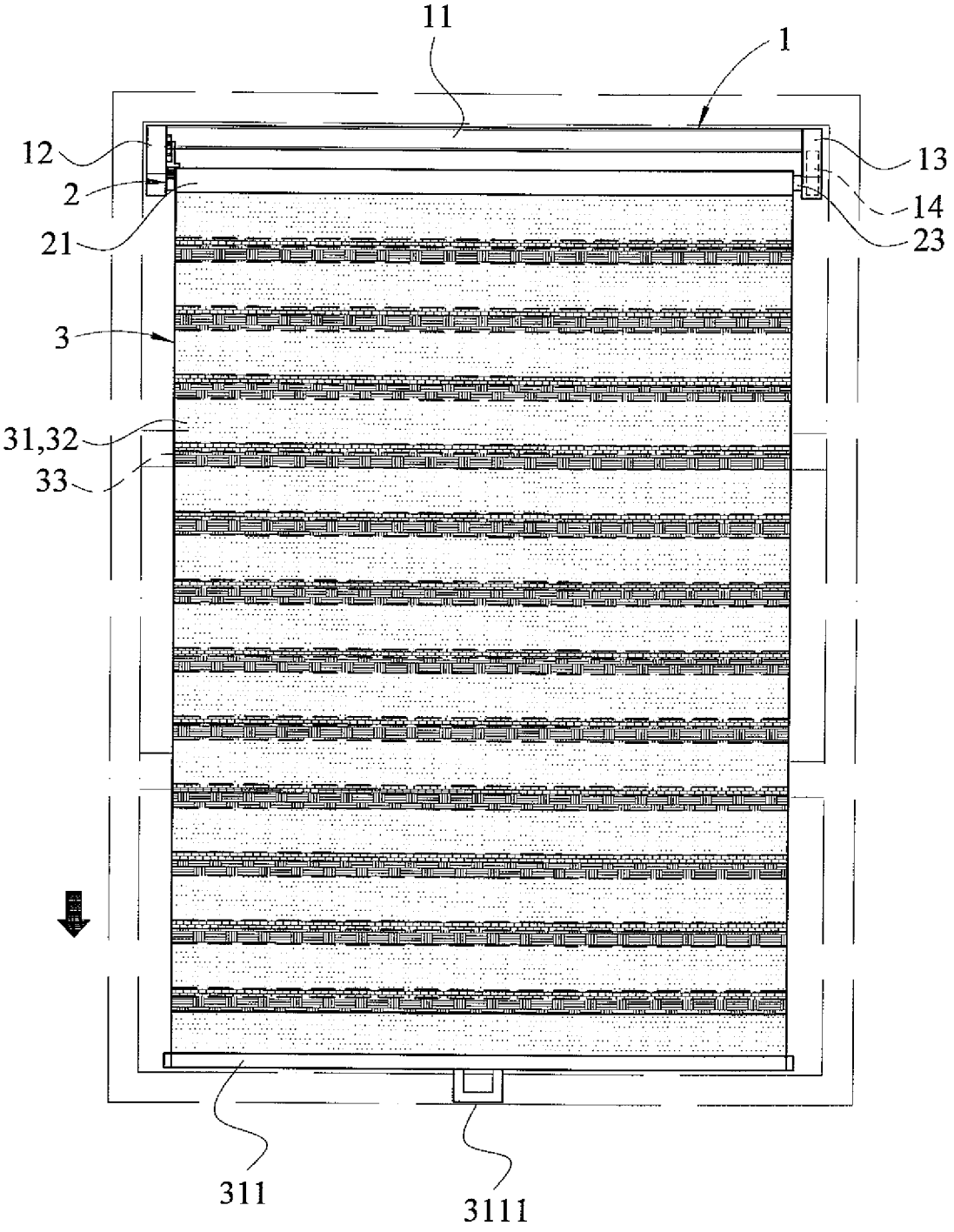
FIG. 6 is a schematic operational view showing expansion of a shading unit of the roller shade as shown in FIG. 1.
Figure 7:
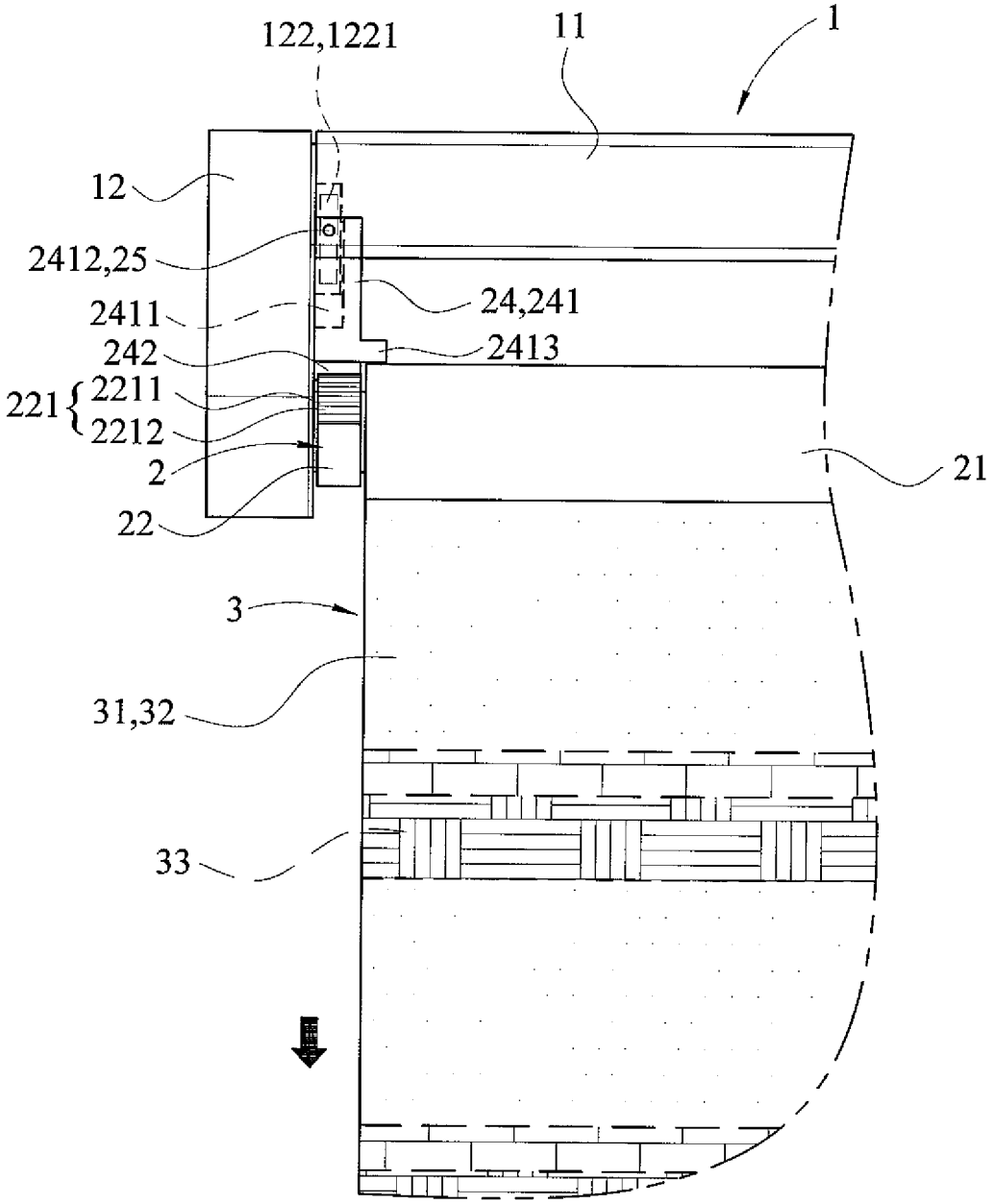
FIG. 7 is a locally enlarged view of the roller shade as shown in FIG. 6.

When the drive portion 3111 is pulled, the shading unit 3 is pulled and expanded downward, and the first shade cloth 31 and the second shade cloth 32 are unwound from the drive shaft 21, so that the abutting portion 2413 of the slide 24 is gradually moved downward by its gravity. When the shading unit 3 is fully developed as shown in FIG. 6, the first shade cloth 31 and the second shade cloth 32 are unwound from the drive shaft 21 completely, and the separation slats 33 are arranged transversely and are parallel with each other as shown in FIG. 1, so that the ambient light passes through the first shade cloth 31, the separation slats 33 and the second shade cloth 32 into the house. At this time, when the shading unit 3 is fully expanded, the first shade cloth 31 and the second shade cloth 32 are unwound from the drive shaft 21 completely to release the abutting portion 2413 of the slide 24, so that the slide 24 is moved downward until the abutting portion 2413 abuts the drive shaft 21 as shown in FIG. 7. At the same time, when the shading unit 3 is fully expanded, the adjusting shaft 22 is rotated to a position where the adjusting portion 221 faces the slide 24, so that the positioning ribs 242 engage the grooves 2212 of the adjusting portion 221 as shown in FIG. 7, and the adjusting portion 221 and the slide 24 present a positioned state.

In adjustment, when the adjusting shaft 22 is rotated slightly, the first shade cloth 31 and the second shade cloth 32 are moved slightly to tilt the separation slats 33, so as to slightly adjust the inclined angle of each of the separation slats 33, thereby regulating the lightness of the sunshine entering the house. At this time, the two positioning ribs 242 of the slide 24 engage any two of the grooves 2212 of the adjusting portion 221 so that the adjusting portion 221 co-operates with the slide 24 to provide a micro-adjustment positioning function.

On the contrary, when the drive portion 3111 is pulled again, the drive shaft 21 is rotated in a reverse direction by operation of the rotary wheel module 14 or the elastic shaft module 16 so as to fold the shading unit 3. In such a manner, when the shading unit 3 is folded upward, the first shade cloth 31 and the second shade cloth 32 are wound around the drive shaft 21 successively by rotation of the drive shaft 21 to push the abutting portion 2413 of the slide 24 upward, while the adjusting shaft 22 is rotated by the drive shaft 21, such that the slide 24 is moved upward, and the positioning ribs 242 are detached from the grooves 2212 of the adjusting portion 221 as shown in FIG. 9. When the first shade cloth 31 and the second shade cloth 32 are wound around the drive shaft 21, the separation slats 33 are compressed by the first shade cloth 31 and the second shade cloth 32, so that the separation slats 33 are arranged in an upright manner and distributed fully between the first shade cloth 31 and the second shade cloth 32 as shown in FIG. 8 to provide a shading effect.

Accordingly, when the shading unit 3 is fully expanded, the inclined angle of each of the separation slats 33 is adjusted by operation of the micro-adjustment device 2 so as to regulate the lightness of the sunshine entering the house and to adjust the shading effect of the shading unit 3.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A roller shade comprising:

a frame unit;

a micro-adjustment device connected with the frame unit; and a shading unit connected with the micro-adjustment device;

wherein:

the frame unit includes a fixed track, a first side bracket mounted on a first end of the fixed track, a second side bracket mounted on a second end of the fixed track, and a rotary wheel module mounted in the second side bracket;

the first side bracket has a face provided with a first shaft hole and a guide rail located above the first shaft hole;

the guide rail is provided with a guide slot;

the second side bracket has a face provided with a second shaft hole;

the micro-adjustment device includes a drive shaft mounted on the frame unit, an adjusting shaft provided on a first end of the drive shaft and pivotally mounted in the first shaft hole, a pivot shaft provided on a second end of the drive shaft and pivotally mounted in the second shaft hole, and a slide slidably mounted on the guide rail and co-operating with the adjusting shaft;

the adjusting shaft has a periphery provided with an adjusting portion located at the first side bracket;

the pivot shaft is connected with the rotary wheel module;

the shading unit includes a first shade cloth having an upper end secured to a rear portion of a top of the drive shaft, a weight bar mounted on a lower end of the first shade cloth, a second shade cloth having an upper end secured to a front portion of the top of the drive shaft, and a plurality of separation slats mounted between the first shade cloth and the second shade cloth;

the adjusting portion of the adjusting shaft includes a plurality of ribs arranged on the periphery of the adjusting shaft, and a plurality of grooves defined between the ribs;

the slide has a first side provided with a block and a second side provided with an abutting portion, the block has a face provided with a slideway mounted on the guide rail and has a side provided with a pin hole connected to the slideway, a limit pin extends through the pin hole of the block and the guide slot of the guide rail so that the slide is mounted on the guide rail, the abutting portion extends from the block, and the block has a bottom provided with two positioning ribs engaging the grooves of the adjusting portion.

2. The roller shade of claim 1, wherein the ribs and the grooves of the adjusting portion have an area of about one quarter to one half (¼-½) of that of the periphery of the adjusting shaft.

3. The roller shade of claim 1, wherein the guide slot of the guide rail has an elongate shape, and the limit pin is movable in the guide slot of the guide rail, so that the slide is slidable on the guide rail.

4. The roller shade of claim 1, wherein a distance between the two positioning ribs is equal to that between the grooves of the adjusting portion.

5. The roller shade of claim 1, wherein both of the first shade cloth and the second shade cloth are made of yarn.

* * * * *